US009848670B2

(12) United States Patent
Khurgin

(10) Patent No.: US 9,848,670 B2
(45) Date of Patent: Dec. 26, 2017

(54) KICKING SHOE ATTACHMENT FOR PROPELLING KICK SCOOTERS AND THE LIKE

(71) Applicant: Boris Khurgin, New York, NY (US)

(72) Inventor: Boris Khurgin, New York, NY (US)

( * ) Notice: Subject to any disclaimer, the term of this patent is extended or adjusted under 35 U.S.C. 154(b) by 0 days.

(21) Appl. No.: 15/418,816

(22) Filed: Jan. 30, 2017

(65) Prior Publication Data

US 2017/0135438 A1 May 18, 2017

Related U.S. Application Data

(63) Continuation-in-part of application No. 15/140,653, filed on Apr. 28, 2016, which is a continuation-in-part of application No. 14/578,631, filed on Dec. 22, 2014, now abandoned.

(51) Int. Cl.

| | |
|---|---|
| ***A43B 5/18*** | (2006.01) |
| ***A43B 7/38*** | (2006.01) |
| ***A43C 11/14*** | (2006.01) |
| ***A43C 15/02*** | (2006.01) |

(52) U.S. Cl.

CPC ..... *A43B 5/18* (2013.01); *A43B 7/38* (2013.01); *A43C 11/1493* (2013.01); *A43C 15/02* (2013.01)

(58) Field of Classification Search

CPC ..... A43B 5/18; A43B 5/0419; A43B 7/38; A43B 3/16; A43B 3/18; A43B 13/145; A43B 13/146; A43B 13/148

USPC ..... 36/7.5, 135, 110, 132

See application file for complete search history.

(56) References Cited

U.S. PATENT DOCUMENTS

| | | | | | |
|---|---|---|---|---|---|
| 3,566,487 | A * | 3/1971 | Beightol | A43B 7/00 | 36/110 |
| 3,584,402 | A * | 6/1971 | Silverman | A61F 13/043 | 36/11.5 |
| 4,206,558 | A * | 6/1980 | Bivona | A43B 3/128 | 273/111 |
| 4,361,972 | A * | 12/1982 | Miller | A43B 5/006 | 36/131 |
| 4,567,678 | A * | 2/1986 | Morgan | A43B 7/00 | 36/11.5 |

(Continued)

FOREIGN PATENT DOCUMENTS

| | | | | |
|---|---|---|---|---|
| FR | 2520988 A1 | * | 8/1983 | A43B 5/02 |
| FR | 2789558 A1 | * | 8/2000 | A43B 5/14 |
| FR | 3000874 | * | 7/2014 | |

*Primary Examiner* — Ted Kavanaugh
(74) *Attorney, Agent, or Firm* — David L. Banner

(57) ABSTRACT

A kicking shoe attachment for use by the rider of a kick scooter having an elongated core with a flat upper surface with an upper sole thereupon, and an opposing curvilinear lower surface with a wear resistant lower sole disposed thereupon. Optionally a heel cup connected to a heel cup carrier plate is slidably supported in a heel cup carrier plate receiver. A latching mechanism allows securing the heel cup and carrier plate in a desired position along a major axis of the elongated core. The elongated core may be split apart horizontally and two or more springs, a block of a resilient material or a scissor jack mechanism may be placed between the portions. An opening may be placed in the upper surface of the elongated body to receive the protruding heel of typically a woman's heeled shoe or boot. A removable plug may fill the hole when unneeded.

22 Claims, 11 Drawing Sheets

(56) References Cited

U.S. PATENT DOCUMENTS

| | | | | |
|---|---|---|---|---|
| 4,773,170 | A * | 9/1988 | Moore | A43B 21/32 36/11.5 |
| 5,722,189 | A * | 3/1998 | Johnson | A43B 1/0054 36/127 |
| 6,421,935 | B1 * | 7/2002 | Bartlett | A43B 7/00 36/132 |
| 6,684,531 | B2 | 2/2004 | Rennex | |
| 6,785,984 | B2 | 9/2004 | Jackinsky | |
| 7,900,377 | B1 | 3/2011 | Perenich | |
| 7,905,033 | B1 | 3/2011 | Perenich | |
| 7,913,422 | B1 | 3/2011 | Perenich | |
| 7,950,166 | B1 | 5/2011 | Perenich | |
| 8,226,096 | B2 | 7/2012 | Reyes, Jr. | |
| 8,627,582 | B2 | 1/2014 | Perenich | |
| 8,627,583 | B2 | 1/2014 | Perenich | |
| 2005/0115117 | A1 * | 6/2005 | Morlin | A43B 5/0417 36/117.3 |
| 2005/0262740 | A1 * | 12/2005 | Salvatelli | A43B 1/0045 36/110 |
| 2009/0133292 | A1 * | 5/2009 | Salvatelli | A43B 1/0045 36/110 |
| 2009/0193684 | A1 | 8/2009 | Diamond | |
| 2012/0036738 | A1 * | 2/2012 | Willis | A43B 5/185 36/73 |
| 2014/0090277 | A1 | 4/2014 | Amos et al. | |

* cited by examiner

Section A - A

Cross Section B - B

Cross Section A - A

KICKING SHOE ATTACHMENT FOR PROPELLING KICK SCOOTERS AND THE LIKE

RELATED APPLICATIONS

This is a Continuation-in-Part application of U.S. application Ser. No. 15/140,653 filed Apr. 28, 2016 that is a Continuation-in-Part application of U.S. application Ser. No. 14/578,631 filed Dec. 22, 2014 for Kicking Shoe Attachment for Propelling Kick Scooters and the Like, both being included herein in their entirety by reference thereto.

FIELD OF THE INVENTION

The invention pertains to footwear attachments and, more particularly, to devices attachable to the sole of a shoe or boot that has a height (i.e., thickness) to allow the "kicking" foot equipped with the device to touch the pavement while requiring little or no bending of the a rider's non-kicking leg standing on the kick scooter.

BACKGROUND OF THE INVENTION

Kick scooters are well known and widely used. In addition, so-called skate boards have become widely used in recent years. A rider, particularly of a kick scooter places one of his or her feet on the horizontal wheeled platform of the kick scooter and uses his or her other foot to exert pressure against the ground. In accordance with Newton's Third Law, for every action, there is an equal and opposite reaction. Consequently the pushing action of a rider's foot against the ground at an acute angle imparts motion (typically forward motion) to the kick scooter.

Once the kick scooter is in motion, the rider may lift his or her "kicking" foot and coast until such time the friction slows the kick scooter and additional pushing is required from the rider.

This action requires constant bending of the rider's leg that stands on the scooter platform while the rider's other leg pushes the scooter forward by kicking back the ground. Such constant leg bending and the resulting shifting of a rider's weight upward and downward with each leg bend may be very tiring.

DISCUSSION OF THE RELATED ART

Several attempts are found in the prior art to provide foot wear that embeds some mechanism in the sole or other lower portion of a shoe or boot that might help alleviate the bending of a kick scooter rider's non-kicking leg.

U.S. Pat. No. 6,684,531 for SPRING SPACE SHOE issued Feb. 3, 2004 to Brian G. Rennex discloses a shoe having a spring biased, compressible ground engaging surface movable relative to the sole. Push-off is discussed (see FIGS. 5A-5C and Column 7, lines 14-41).

United States Published Patent Application No. 2014/0090277 published Apr. 3, 2014 upon application by Michael S. Amos et al. shows a first sole member 28 that can move relative to a second sole member 30 for push off (paragraph 26). The sections 30, 28 are positioned fore and aft.

U.S. Pat. No. 8,627,583 issued Jan. 14, 2014 to Stephen Perenich shows a shoe with an extensible sole (FIGS. 11, 12, 31 and 32). Perenich also has U.S. Pat. Nos. 7,900,377; 7,905,033; 7,913,422; 7,950,166; and 8,627,582, all generally similar in disclosure.

U.S. Pat. No. 8,226,096 for MOBILE PLATFORM ASSEMBLY issued Jul. 24, 2012 to Jaime Alberto Reyes, Jr., discusses assisting with push-off in a wheeled, body bearing vehicle.

United States Published Patent Application No. 2009/0193684 for CONVERTIBLE SHOE published Aug. 6, 2009 upon application by Laurence Diamond, shows a "foot bed" 92 which may be stacked on a sole to modify wearer height (paragraph 41).

U.S. Pat. No. 6,785,984 for WALKING SHOE issued Sep. 7, 2004 to Carmine U. Jackinsky shows a thick sole deck for a shoe (FIG. 1).

None of the patents and published patent applications, taken singly, or in any combination are seen to teach or suggest the Kicking Shoe Attachment for Propelling Kick Scooters and the Like of the present invention.

It would, therefore, be beneficial to provide an attachment for a shoe or boot to be worn on the kicking foot of a kick scooter rider that would minimize the amount of bending of non-kicking leg of the rider when riding a kick scooter.

SUMMARY OF THE INVENTION

In accordance with the present invention there is provided an accessory attachable to the shoe of a kick scooter rider. A kick scooter rider has a stationary foot placed on the platform of the kick scooter. The rider's other foot (i.e., the kicking foot) is used to propel the kick scooter. As the rider "kicks" the ground, the stationary leg must bend with each pushing stroke. As the stationary leg bends, the entire weight of the rider is supported thereupon. The constant flexing of the stationary leg may be very tiring.

Attaching the kicking shoe attachment in accordance with the invention to the shoe of the kicking foot of the rider effectively extends the length of the kicking leg allowing the bottom of the kicking shoe attachment to contact the ground with little or no bending of the rider's stationary leg.

For casual riding, the height of the kicking shoe attachment is typically designed to be approximately equal to the height of the upper surface of the kick scooter's deck above the ground. However, for a "sporting" style of riding, such an approximately 1:1 ratio of heights may not provide desirable power from the kicking strokes. If the height of the kicking shoe attachment is made lower (i.e., the kicking shoe attachment is made thinner), the rider's center of gravity is shifted toward the kicking foot thereby allowing more powerful kicking strokes.

A main body core of the kicking shoe attachment is formed from any lightweight sturdy material (e.g., aluminum, plastic, etc.) and may be made in one, two, or more parts. In a two-part body, the parts are arranged one above the other typically with a resilient structure sandwiched between the upper and lower body portions. The resilient structure may include one or more springs or it may be formed from an elastomeric material. The resilient structure between the upper and lower body portions reduce the shock to the kicking leg.

In yet other embodiments, a height adjusting device may be disposed between an upper and lower body portion to allow the overall height of the kicking shoe attachment to be varied to accommodate different kick scooters, riding styles (e.g., relaxed, sporty, etc.), and/or rider footwear.

The main body includes a substantially flat upper surface and is adapted to receive the shoe of the rider thereupon. In a first embodiment, only a toe strap is used to secure a kick scooter's rider's footwear to the top surface of the main body. An elongated opening in the top surface of the main body and the upper sole accepts the heel of typically a woman's shoe.

In a second embodiment, a heel retaining cup is adjustably attached to the substantially flat upper surface by a flat heel cup retainer plate. The heel cup retainer plate may be moved forward and backward along the major axis of the main body. A retaining mechanism is used to secure the position of the heel cup and the heel cup retainer plate along the major axis. Adjustability of the heel retaining cup helps secure the Kicking Shoe Attachment in accordance with the invention more securely to shoes of different sizes and/or styles.

A hole in the heel cup retainer plate allows a downwardly-protruding heel portion of a shoe to be accommodated in a heel receiver groove or trough in the upper surface of the main body.

When not used, a removable plug is provided to fill the unused hole.

An upper sole, typically made of rubber or any other suitable non-skid and/or cushioning material is attached to the upper surface of the upper body portion. The upper sole provides a stable surface to support the stationary leg of the kick scooter rider.

The bottom surface of the main body is preferably has a convex shape to provide good contact with the ground during the entire duration of the kicking or propelling stroke as the angle of the kicking leg relative to the ground changes. A lower sole also made from rubber or any other suitable durable material is attached to the curved lower surface of the lower body portion. The lower sole provides good traction during the contact with the ground.

For casual riding, the height of the main body, including upper and lower soles is ideally chosen to be substantially equal to the height of the scooter's platform above the ground. Such a height ensures minimum bending of a rider's stationary leg with each propelling (i.e., kicking) stroke. As previously mentioned, for a "sporting" style of riding, the kicking shoe attachment may be made lower than the height of the kick scooter platform.

An adjustable harness may be attached to the upper surface of the upper body portion typically using a quick-release or other safety binding devices. The harness retains the shoe of the kick scooter rider tightly against the upper sole of the upper body portion of the kicking shoe attachment.

A tether or other security device may be included to lock the novel kicking shoe attachment to an environmental structure or to the kick scooter when it is not in use.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

The present invention provides an attachment for a shoe, boot, etc. of the kicking foot of a rider of a kick scooter to facilitate propelling the kick scooter, skateboard, or similar device while minimizing the bending of the stationary leg of the rider during kicking strokes.

Figure 1:
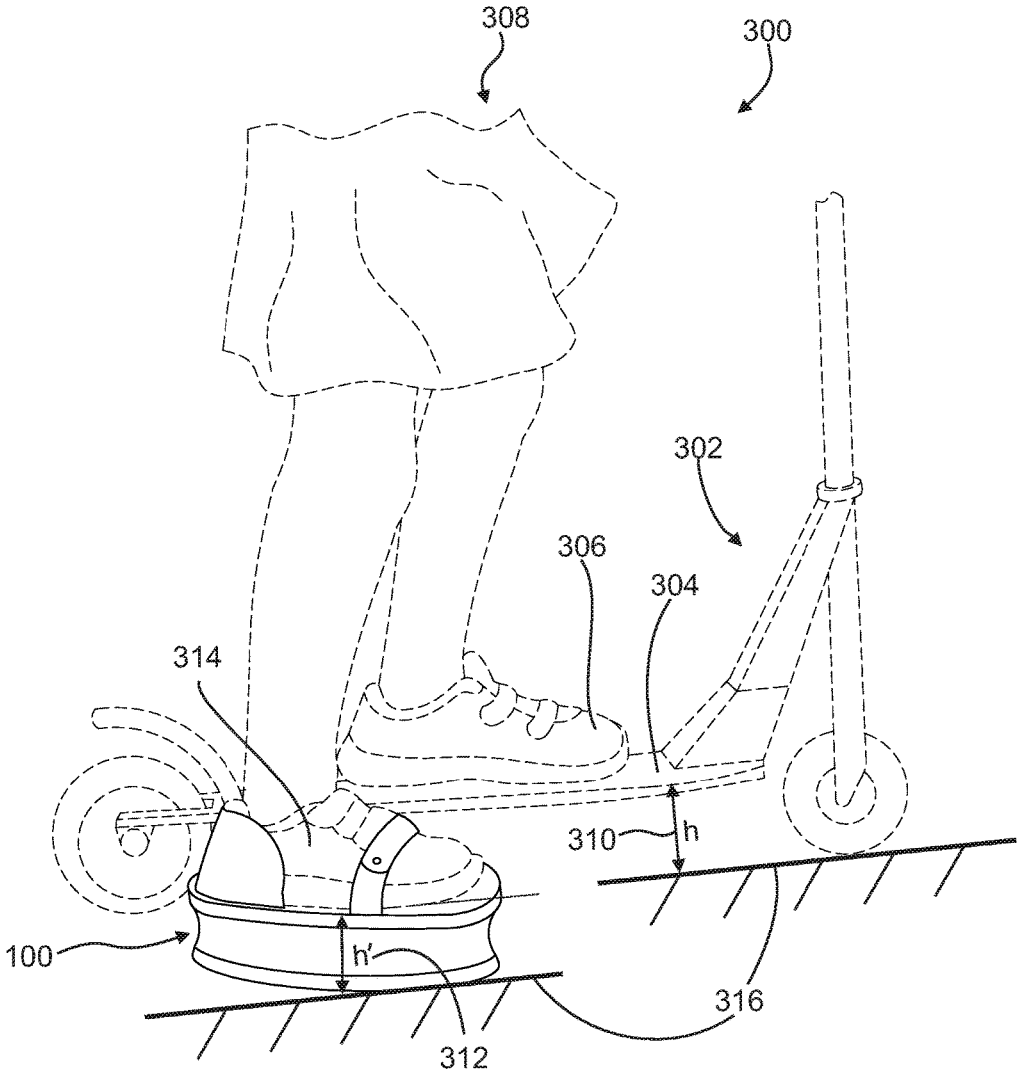
FIG. 1 is a perspective, schematic view of a typical kick scooter showing a portion of a rider having a kicking shoe attachment attached in accordance with the invention worn on the kicking foot of a rider.

Referring first to FIG. 1, there is shown a perspective, schematic view of a typical kick scooter showing a portion of a rider having a kicking shoe attachment in accordance with the invention attached to his/her kicking foot, generally at reference number 300. A typical kick scooter 302 forms no part of the present invention and is shown only to illustrate the intended operating environment of the kicking shoe attachment of the invention.

Kick scooter 302 has a deck 304 comprising a flat surface for receiving the stationary foot 306 of a rider 308. Rider 308 also forms no part of the present invention.

The upper surface of deck 304 is disposed at a height "h" 310 above the surface of the pavement or other surface 316 upon which the kick scooter 302 is being ridden.

A representative kicking shoe attachment 100*b* is shown on kicking foot 314 of rider 308. Several embodiments of a kicking shoe attachment are disclosed hereinbelow and any of the disclosed embodiments may be substitutes for kicking shoe attachment 100*b* shown in FIG. 1.

Kicking shoe attachment 100*b* has a height (i.e., vertical thickness) h' 312. Height h' 312 is either approximately equal to or less than height h 310. When heights h 310 and h' 312 are equal, bending of the stationary leg of a rider during a kicking stroke is minimized.

If height h' 312 of the kicking shoe attachment 100*b* is less than deck height h 310, more bending of the knee of the rider's stationary leg will be required during kicking strokes. However, more powerful kicking strokes may possibly be produced when the rider is in "sporting" riding mode where such more powerful strokes are probably beneficial.

Figure 2A:
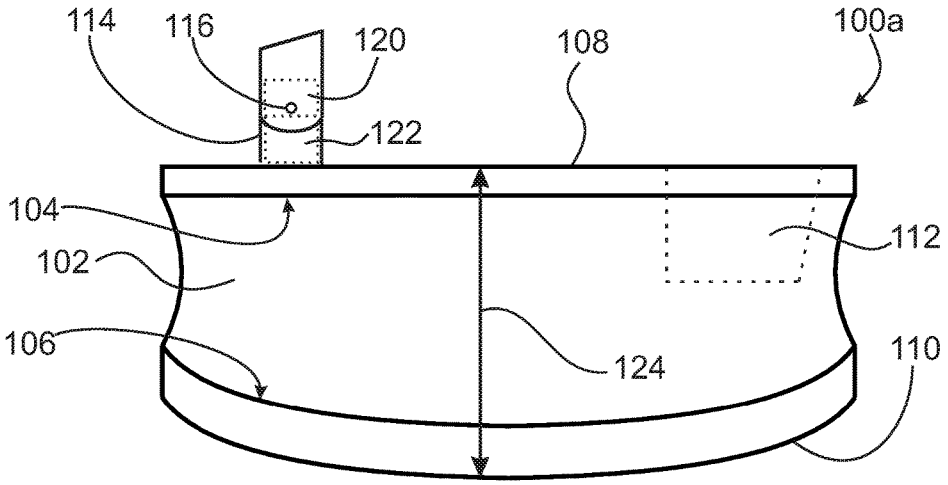
FIG. 2A is a side elevational, schematic view of a first, solid body embodiment of the kicking shoe attachment in accordance with the invention.
Figure 3A:
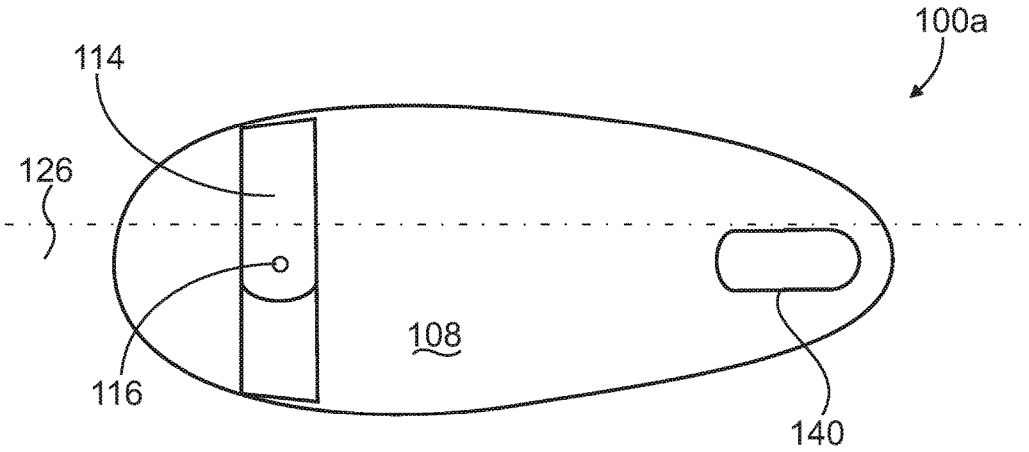
FIG. 3A is a top plan, schematic view of the kicking shoe attachment as shown in FIG. 2A with no heel cup carrier.

Referring now also to FIGS. 2A, and 3A there are shown side elevational and top plan schematic views, respectively, of first embodiment of a kicking shoe attachment in accordance with the invention, generally at reference number 100*a*.

A solid main body core 102 has a substantially flat upper surface 104, and a convex lower surface 106. In this embodiment, main body core 102 is formed from a solid piece of sturdy, lightweight material. Such lightweight, sturdy materials include lightweight metals such as aluminum and polymers such as ABS. It will be recognized that numerous other lightweight, sturdy materials may be known to those of skill in the art and, consequently, the invention is not limited by the material examples chosen for purposes of disclosure. Rather, the invention is intended to include any suitable main body core 102 material.

An upper sole 108 is fastened to the upper surface 104 of main body core 102. Upper sole 108 is typically formed from rubber, either natural or artificial, or from another polymeric elastomer. Upper sole 108 is ideally formed from a non-slip material upon which the shoe of a rider of the device being used with kicking attachment 100*a* rests. Further, the invention is not intended to be limited to the upper sole 108 material chosen for purposes of disclosure. Rather, the invention is intended to include any suitable upper sole 108 material.

A lower sole 110 is fastened to a lower, convex, curvilinear surface 106 of main body core 102. Lower sole 110 is formed from a wear resistant material designed to wear well as lower sole 110 is kicked against the horizontal surface on which the kick scooter, etc. is being propelled by a rider thereof. Further, the invention is not intended to be limited to the lower sole 110 material chosen for purposes of disclosure. Rather, the invention is intended to include any suitable lower sole 110 material.

It will be further recognized by those of skill in the art that lower sole 110 may be attached to lower, convex, curvilinear surface 106 in a manner that facilitates its replacement when worn or damaged. Device and/or methods for replaceably fastening lower sole 110 to lower surface 106 are believed to be well known to those of skill in the art and, consequently such devices and/or methods are not further discussed herein.

A front retaining strap 114 or similar structure is disposed forward on upper sole 108. Front retaining strap 114 is adapted to adjustably and securely retain the toe region of the rider's shoe against upper sole 108. A hook-and-loop fastening system is typically utilized to provide the adjustability required for the application. The hook-and-loop fastening system has a first portion 120 of either hook or loop material and second portion 122 formed from the opposite one of hook or loop material, disposed on surfaces of front retaining strap 114 in ways believed to be well known to those of skill in the art.

A heel receiving space 112 is provided to accept a protruding heel attached to the sole of footwear, typically women's footwear. Heel receiving space 112 typically is configured as an elongated groove.

Figure 2B:
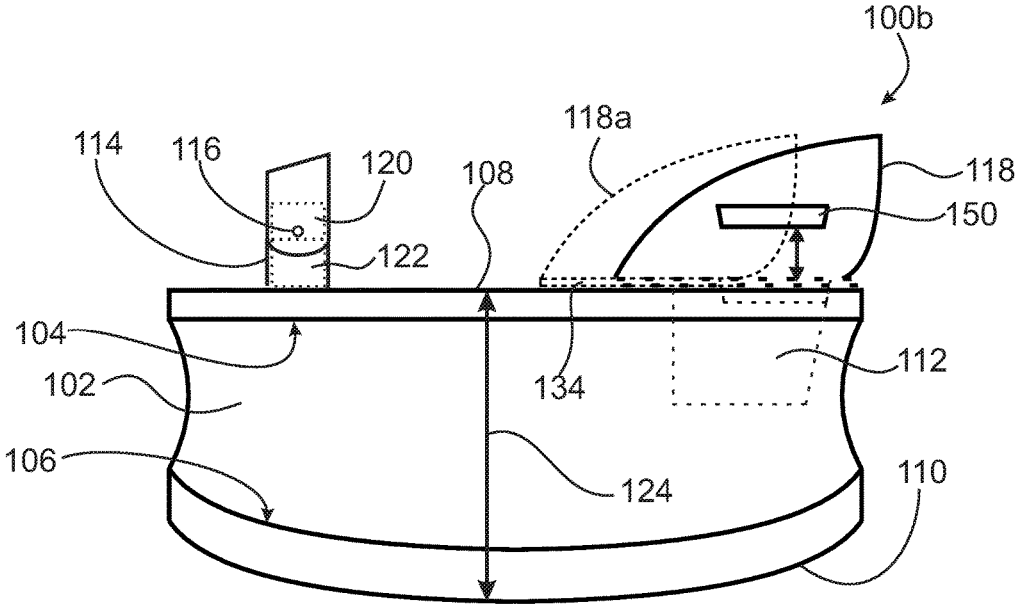
FIG. 2B is a side elevational, schematic view of a second, solid body embodiment of the kicking shoe attachment in accordance with the invention.

Referring now also to FIG. 2B, there is shown a side elevational, schematic view of first embodiment of a kicking shoe attachment in accordance with the invention, generally at reference number 100*b*.

Kicking shoe attachment 102*b* has a solid main body core 102 having a substantially flat upper surface 104, and a convex lower surface 106 identical to kicking shoe attachment 100*a* of FIG. 2A.

An upper sole 108 is fastened to the upper surface 104 of main body core 102. Upper sole 108 is typically formed from rubber, either natural or artificial, or from another polymeric elastomer. Upper sole 108 is ideally formed from a non-slip material upon which the stationary shoe of a rider of the device being used with kicking attachment 100*b* rests. Further, the invention is not intended to be limited to the upper sole 108 material chosen for purposes of disclosure. Rather, the invention is intended to include any suitable upper sole 108 material.

A lower sole 110 is fastened to a lower, convex, curvilinear surface 106 of main body core 102. Lower sole 110 is formed from a wear resistant material designed to wear well as lower sole 110 is kicked against the horizontal surface on which the kick scooter, etc. is being propelled by a rider thereof. Further, the invention is not intended to be limited to the lower sole 110 material chosen for purposes of disclosure. Rather, the invention is intended to include any suitable lower sole 110 material.

It will be further recognized by those of skill in the art that lower sole 110 may be attached to lower, convex, curvilinear surface 106 in a manner that facilitates its replacement when worn or damaged. Device and/or methods for replaceably fastening lower sole 110 to lower surface 106 are believed to be well known to those of skill in the art and, consequently such devices and/or methods are not further discussed herein.

A front retaining strap 114 or similar structure is disposed forward on upper sole 108. Front retaining strap 114 is adapted to adjustably and securely retain the toe region of the rider's shoe against upper sole 108. A hook-and-loop fastening system is typically utilized to provide the adjustability required for the application. The hook-and-loop fastening system has a first portion 120 of either hook or loop material and second portion 122 formed from the opposite one of hook or loop material, disposed on surfaces of front retaining strap 114 in ways believed to be well known to those of skill in the art.

In alternate embodiments, one or more snap fasteners 116 may be used to secure front retaining strap 114.

A heel retaining cup 118 is attached at its lower edge to an upper surface, not specifically identified, of a heel cup carrier plate 134. Heel cup carrier plate 134 is slidably retained on upper sole 108 by heel cup carrier plate receiver 136, best seen on FIG. 3D, proximate a rear edge thereof.

Heel cup carrier plate 134 is slidably secured to heel cup carrier plate receiver 136 that is, in turn, secures to upper sole 108 and/or upper surface 104 of main body 102.

The sliding attachment of heel cup carrier plate 134 to heel cup carrier plate receiver 136 allows forward and backward movement of heel cup 118, thereby accommodating shoes of different sizes to be securely attached to the Kicking Shoe Attachment.

In alternate embodiments, the function of heel cup carrier plate receiver 136 may be replaced by horizontal grooves, not shown, in main body 102. These grooves are disposed in opposing sides of main body 102 proximate upper surface 104. The grooves are disposed and configured to receive and retain heel cup carrier plate 134 as seen in FIG. 3D.

A substantially circular opening in heel cup carrier plate 134 and an elongated opening in upper sole 108 provide access to a hollow heel receiving space 112 formed in solid body core 102. Heel receiving space 112 is provided to accept a protruding heel attached to the sole of footwear, typically women's footwear. Heel receiving space 112 typically is an elongated groove.

The combination of elongated main body core 102, upper sole 108, and lower sole 110 has a height 124 corresponding to height h' 312 of FIG. 1.

Referring now also to FIG. 3A, there are shown top plan, schematic views of the kicking shoe attachment of FIG. 2A. No heel cup 118 (FIGS. 3B-3D) is present in this embodiment.

Figure 3B:
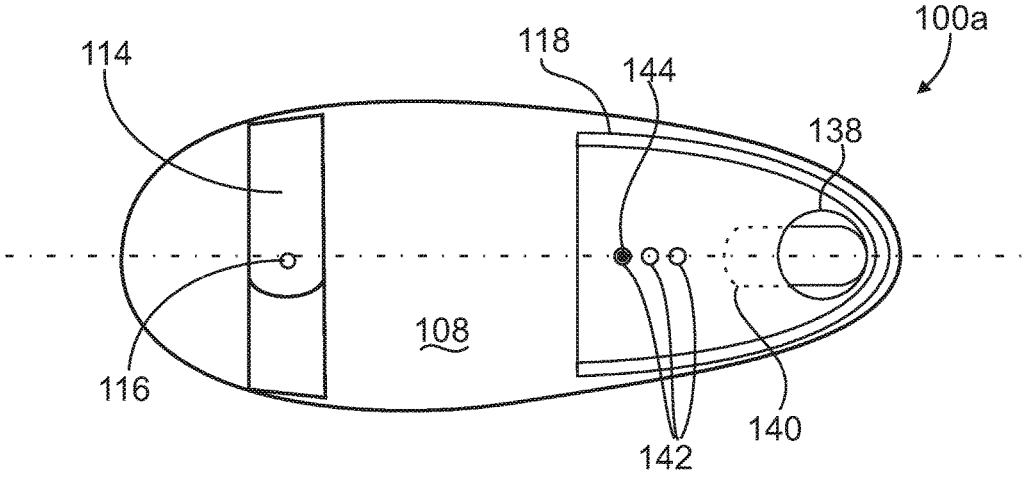
FIG. 3B is a top plan, schematic view of the kicking shoe attachment as shown in FIG. 2B with a heel cup carrier secured in the rear most orientation.
Figure 3C:
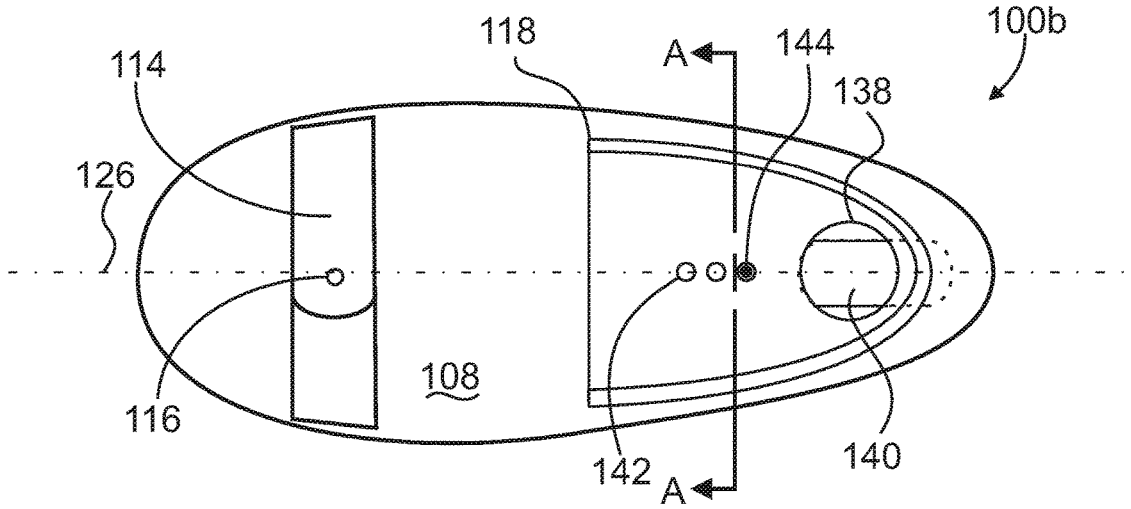
FIG. 3C is a top plan, schematic view of the kicking shoe attachment as shown in FIG. 2B with a heel cup carrier secured in the foremost orientation.
Figure 3D:
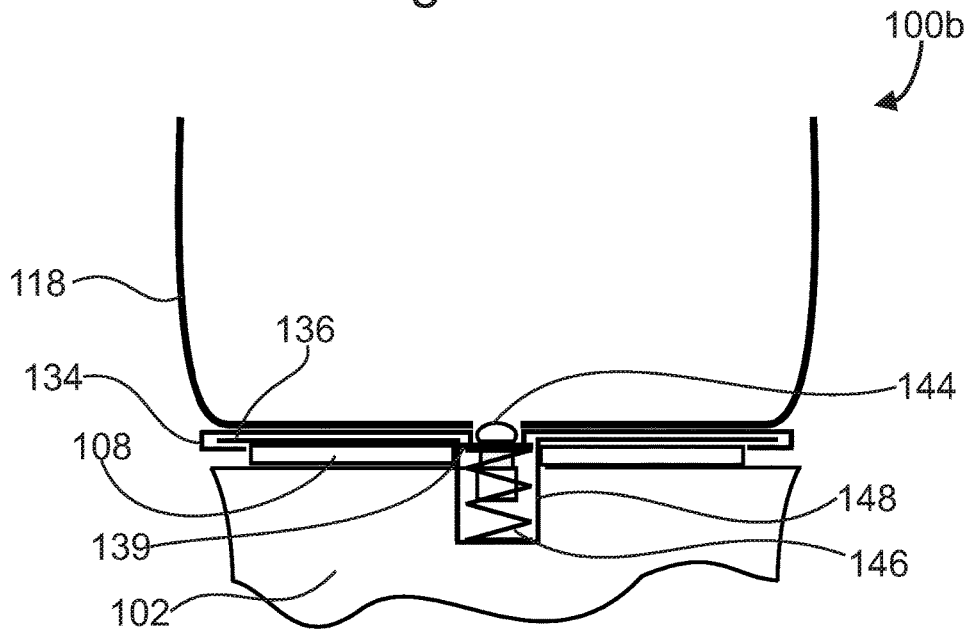
FIG. 3D is front cross-sectional view along section A-A as shown in FIG. 3C and providing a detailed view of a securing mechanism.

Referring now also to FIGS. 3B and 3C, there are shown top plan, schematic views of the kicking shoe attachment of FIG. 2B. In FIG. 3B, heel cup 118 is shown in its rear-most position while in FIG. 3C, heel cup 118 is shown in its most forward position. As may readily be seen, main body core 102 has an elongated, ovulate shape corresponding roughly to the outline of a shoe or boot.

Front retaining strap 114 or similar structure disposed forward on upper sole 108, may be replaced with numerous other footwear retention mechanisms believed to be well known to those of skill in the art. One such well-known, useful replacement could be a quick release binding mechanism, not shown, commonly used on skis, skateboards, etc.

Referring now also to FIG. 3D, there is shown a front enlarged cross-sectional view A-A. Heel cup 118, heel cup carrier plate 134 and heel cup carrier plate receiver 136 may readily be seen. In addition, a latching mechanism that maintains heel cup 118 and heel cup carrier plate 134 in a desired position. The latching mechanism consists of a depressible button 144 having a button lip 138 in a button well 148. A spring 146 maintains upward pressure on a lower surface, not specifically identified, of button lip 139 and the button 144 so as to hold button 144 in a selected one of openings 142, best seen in FIGS. 3B and 3C.

Figure 4A:
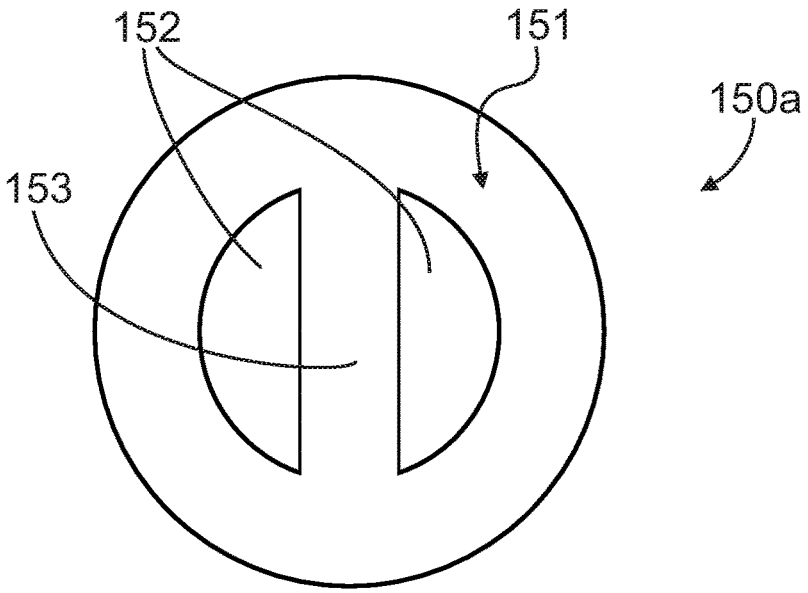
FIGS. 4A and 4B show a top plan and side elevational, schematic view, respectively, of a first embodiment of a plug.
Figure 4B:
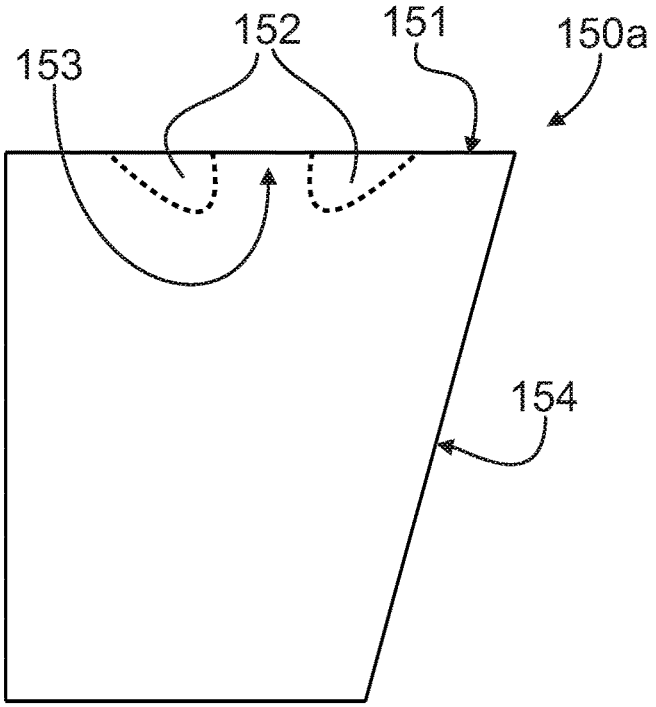

Referring now also to FIGS. 4A and 4B, there are shown top plan and side elevational, schematic drawings of a first embodiment of a plug 150*a* for insertion in substantially circular hole 138 of heel cup carrier plate 134.

Plug 150*a* has a substantially circular cross-section and a substantially flat upper surface 151. A pair of finger recesses 152 is formed in upper surface 151 on either side of central region 153.

Plug 150*a* has at least one side vertical wall having a taper 154.

Figure 4C:
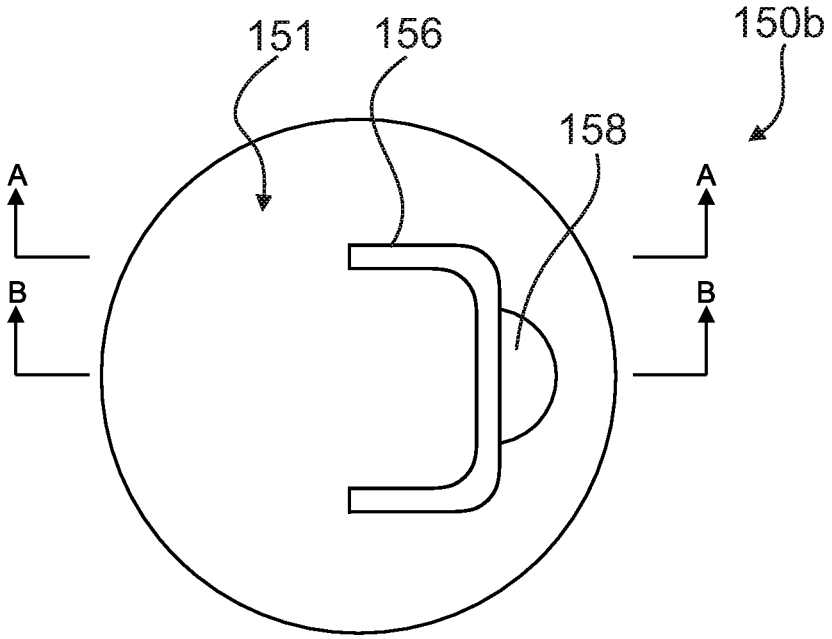
FIGS. 4C, 4D, and 4E show a top plan and two side elevational, schematic views, respectively, of a second embodiment of a plug.
Figure 4D:
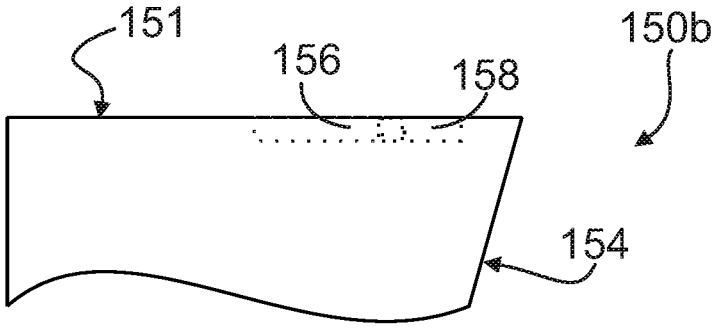
Figure 4E:
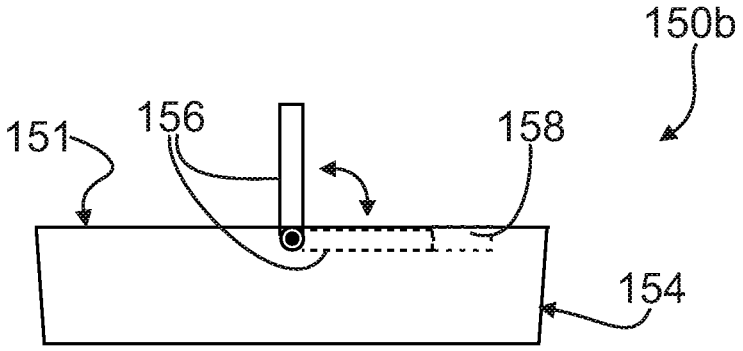

Referring now also to FIGS. 4C, 4D and 4E, there are shown a top plan, a first vertical cross-sectional and a second vertical cross-sectional, schematic view, respectively, of a second embodiment of a plug, generally at reference number 150*b*.

Plug 150*b* has a substantially flat upper surface 151 with a single finger recess 158 and a pivotable handle 156 disposed therein. Pivotable handle 156 is movable from a flat, stored orientation as shown in FIGS. 4C and 4D. In its flat, stored orientation, pivotable handle 156 lies substantially flush with upper surface 151.

Pivotable handle 156 may be raised to a vertical, operable orientation as shown in FIG. 4E. When in its vertical, operable orientation, handle 156 may be used to facilitate extraction of plug 150*b* from substantially circular opening 138 138 in heel cup carrier plate 134.

Figure 5:
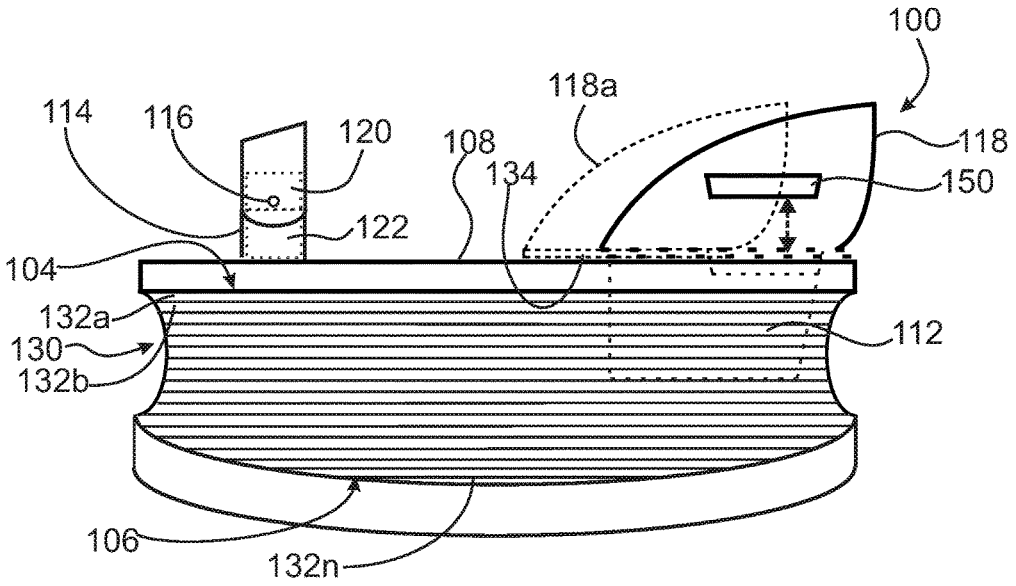
FIG. 5 is a side elevational, schematic view of the kicking shoe attachment with a laminated solid body.

It will be further recognized that main body core 102 may alternatively be formed by laminated layers. Referring now also to FIG. 5, there is shown a side elevational, schematic view of a kicking shoe attachment having such an elongated main body core construction. Main body core 102 as shown in FIG. 2 is replaced by a laminated body core 130 comprising a plurality of layers 132*a*, 132*b* . . . 132*n*. Layers 132*a*, 132*b* . . . 132*n* may be formed from a single material such as wood, plastic, rubber, etc. In alternate embodiments, layers 132*a*, 132*b* . . . 132*n* may be formed from two or more different materials. In one possible construction, layers of cork may be interspersed among layers of wood, rubber, or plastic, etc. to provide a cushioning (e.g., damping or shock absorbing) effect for the kicking foot, not shown.

Figure 6:
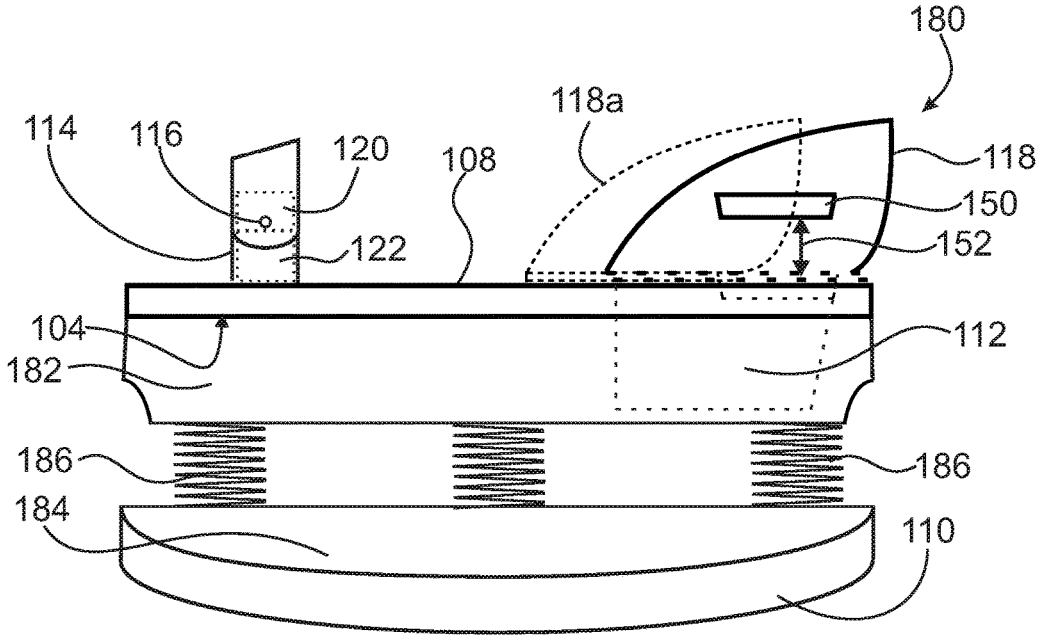
FIG. 6 is a side elevational, schematic view of a second embodiment of the kicking shoe attachment with springs within the body in accordance with the invention.

Elongated main body core 102 lends itself well to formation by traditional laminating processes wherein successive vertical layers are adhesively bonded to one another Referring now also to FIG. 6, there is shown a side elevational, schematic view of a second embodiment of the kicking shoe attachment with springs within the elongated main body, generally at reference number 180.

In the kicking shoe attachment 180 elongated main body core 102 of kicking shoe attachment 100*b* is split into two portions; an upper body portion 182 and a lower body portion 184. The combined thickness of upper body portion 182 and lower body portion 184 is smaller than the thickness of solid main body core 102.

Coil springs 186 are interposed between a lower surface of upper body portion 182 and an upper surface of lower body portion 184. Springs 186 are typically coil springs having sufficient stiffness to maintain connective integrity between upper body portion 182 and lower body portion 184 while providing a kicking assist to the rider of a kick scooter.

While coil springs 186 are shown for purposes of disclosure, it will be recognized by those of skill in the art that springs of other types, for example, leaf springs, may readily be substituted for coil springs 186. Consequently, the invention is not considered limited to the coil springs chosen for purposes of disclosure. Rather, the invention is intended to include any and all other suitable forms of springs.

Figure 7:
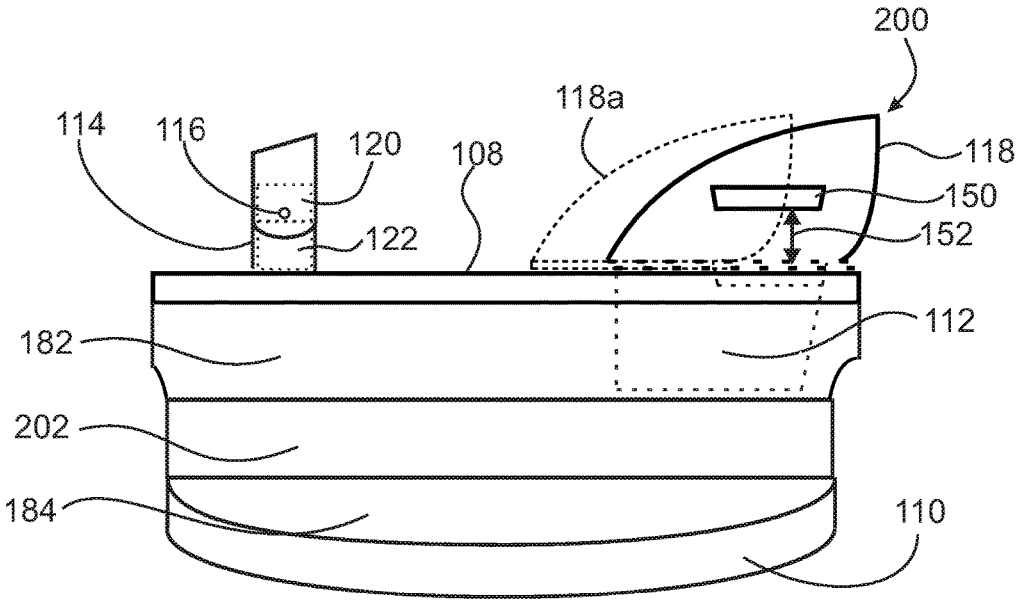
FIG. 7 is a side elevational, schematic view of a third embodiment of the kicking shoe attachment with resilient material within the body in accordance with the invention.

Referring now also to FIG. 7, there is shown a side elevational, schematic view of a third embodiment of the kicking shoe attachment with resilient material within the body generally at reference number 200.

In kicking shoe attachment 200, springs 186 (FIG. 6) are replaced by a block of a resilient material 202. Materials such as polyurethanes, latex, or polyether urethanes (EU) elastomeric foam have been found suitable for the application. It will be recognized by those of skill in that art that suitable other material may be available. Consequently, the invention is not considered limited to the materials chosen for purposes of disclosure. It is anticipated that kicking shoe attachment 200 is less expensive to manufacture while still providing the kicking assist benefits of kicking shoe attachment 180. Resilient material 202 may readily be adhesively attached to a lower surface of upper body portion 182 and an upper surface of lower body portion 184.

Figure 8:
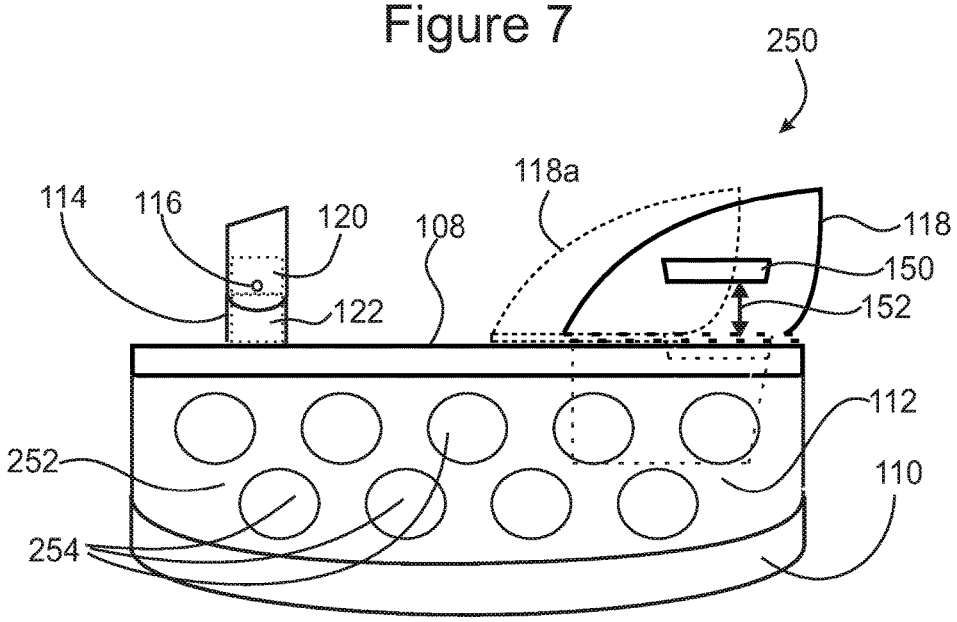
FIG. 8 is a side elevational, schematic view of a fourth embodiment of the kicking shoe attachment with weight-reducing holes within the body in accordance with the invention.

Referring now also to FIG. 8, there is shown a side elevational, schematic view of a fourth embodiment of the kicking shoe attachment with a one piece body generally at reference number 250.

Kicking shoe attachment 250 is nearly the same as kicking shoe attachment 100*b* with the exception that solid main body core 102 is replaced with a main body 252 that has a plurality of through holes 254 from side to side. Through holes 254 are provided to reduce the weight of kicking shoe attachment 250 and enhance cushioning to body 252 in cases where body 252 is formed from an elastic material while maintaining the necessary height and structural integrity.

While through holes 254 are shown in a regular pattern for purposes of disclosure, it may be desirable to arrange through holes 254 in a more random pattern for structural purposes.

Figure 9:
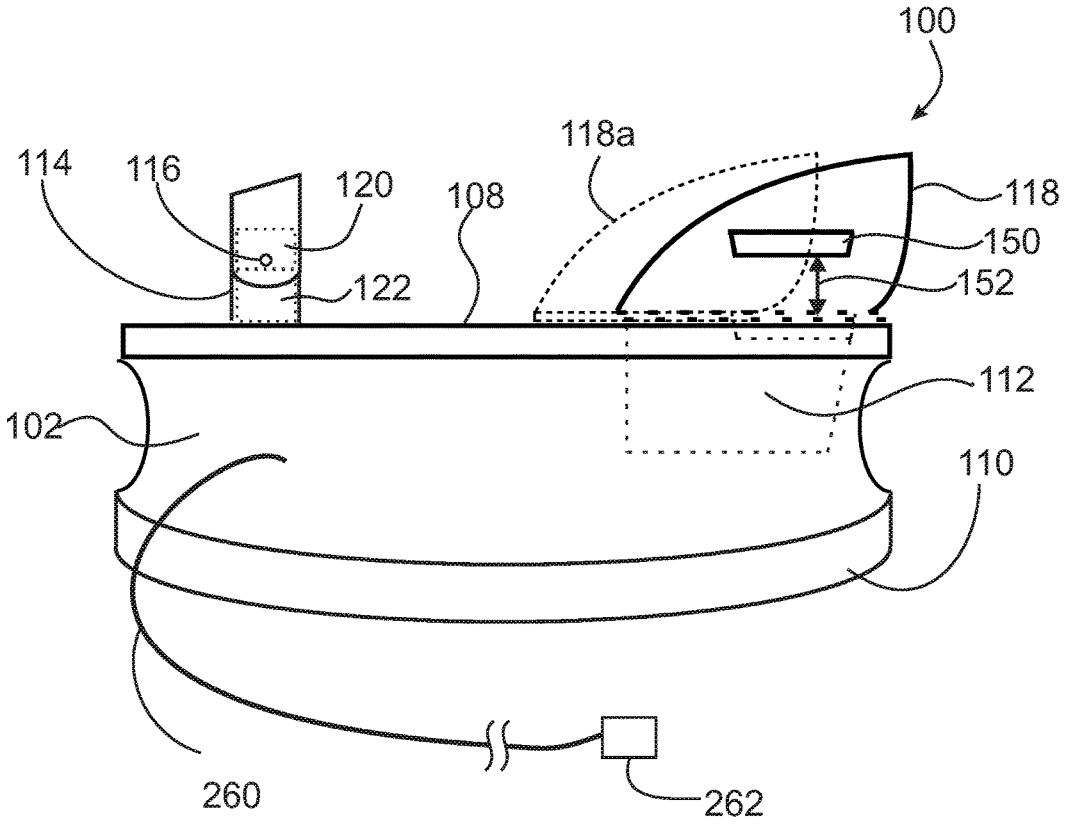
FIG. 9 is a side elevational, schematic view of the kicking shoe attachment of FIG. 2 but having a tether attached to the main body.

Referring now also to FIG. 9, there is shown the kicking shoe attachment of FIG. 2 with an attached tether 260. Tether 260 is securely anchored in elongated main body core 102 and extends outwardly therefrom. A locking apparatus, not shown, may be used to attach tether 260 to elongated main body core 102.

A locking device useful for securing kicking shoe attachment to an environmental structure is shown schematically at reference number 262 at a distal end, not specifically identified, of tether 260. Locking device 262 may alternately be attached to kicking shoe attachment 100*a*, 100*b* to prevent dangling of teacher 260 when the kick scooter is being ridden.

Figure 10:
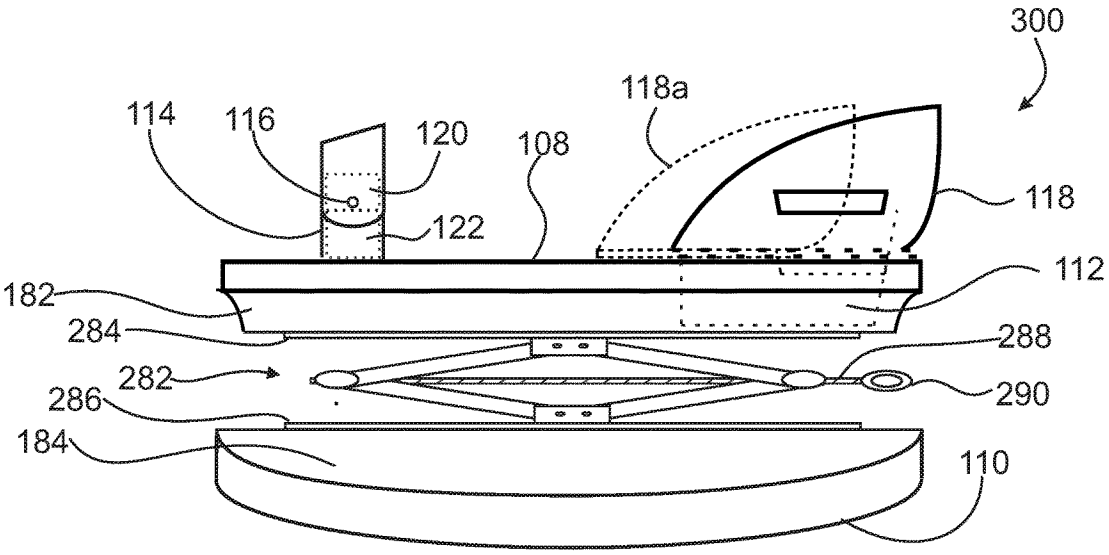
FIG. 10 is a side elevational, schematic view of an embodiment of the kicking shoe attachment having an adjustable height mechanism within the body in accordance with the invention.

Referring now also to FIG. 10, there is shown a side elevational, schematic view of yet another embodiment of the kicking shoe attachment, generally at reference number 300.

Kicking shoe attachment 300 incorporates a height adjusting mechanism 282 that allows a user to adapt kicking shoe attachment 300 for use with multiple kick scooters having varying deck heights h 310 (FIG. 1). In addition, as the soles of footwear to which kicking shoe attachment 300 may be attached may vary significantly, height adjustment mechanism 282 may be used to "tweak" the height h' 312 of FIG. 1 for optimum kicking performance, especially minimum bending of the stationary leg of the rider.

Height adjusting mechanism 282 is a scissor jack mechanism wherein a lead screw 288 may be rotated by applying a crank or the like to eye 290. Lead screw passes through a pair of captive nuts, not shown at each end of a pair of scissor arms, not specifically identified. Scissor jack mechanisms are believed to be well known to those of skill in the art. Consequently, the more exact details on height adjusting mechanism 282 are not provided herein. It will be readily apparent to those of skill in the art that any variation of scissor jack mechanism may be adapted for use with kicking shoe attachment 300. It will be further apparent to one of skill in the art that other styles of similar devices may be substituted for scissor jack 282. Consequently, the novel kicking shoe attachment is not considered limited to the scissor jack used for purposes of disclosure. Rather, any suitable height-adjusting mechanism may be substituted.

Height-adjusting mechanism readily allows a rider to adjust his/her kicking shoe attachment to an optimum height for the style of riding (i.e., casual or "sporting") the rider anticipates.

One or more stabilizing structures may be added, if required, to maintain vertical alignment of core portions 182 and 184.

It will be recognized that alternate embodiments of kicking shoe attachment may be configured for attachment only to the toe end of a rider's footwear. One possible way to retain such an embodiment of a kicking shoe attachment is using an adjustable-width toe clamp similar to such clamps used on clamp-on roller skates. Such clamps are typically fastened in place by a so-called skate key that tightens or loosens the toe clamps.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A kicking shoe attachment, comprising:

a) an elongated main body comprising: a central core having a flat upper surface and a spaced apart convex, curvilinear lower surface; an upper sole covering disposed on said flat upper surface; and a lower sole covering disposed on said spaced apart convex curvilinear lower surface;

b) a device for adjustably securing at least a toe region of footwear of a wearer of said kicking shoe attachment to said upper sole; and c) an elongated, heel-receiving slot disposed in said upper surface of said elongated main body and having a first terminus proximate a rear edge of said elongated main body and a second terminus forward therefrom, said elongated slot being aligned on a major axis of said elongated body, said upper sole covering have a hole therethrough corresponding in size, shape and location to an opening in said upper surface of said elongated body.

2. The kicking shoe attachment as recited in claim 1, further comprising:

d) a heel receiving cup attached to said upper sole and said upper surface of said elongated body.

3. The kicking shoe attachment as recited in claim 2, wherein said central core disposed between said upper sole covering and said lower sole covering and comprises at least one of the group: a solid object of a single material, a solid object of a single material having at least one horizontal opening therethrough; a solid object laminated from multiple horizontal layers; a two-part solid object having a resilient material disposed intermediate said two parts, a two-part solid object having at least one mechanical spring disposed intermediate said two parts, and a two-part solid objects having a height-adjusting mechanism disposed intermediate said two parts.

4. The kicking shoe attachment as recited in claim 3, wherein said central core comprises an upper core portion and a lower core portion separated horizontally in a plane substantially parallel to said flat upper surface, said upper core portion and said lower core portion being spaced apart in a vertical dimension by at least one mechanical spring selected from the group: coil springs, leaf springs, and other forms of spring.

5. The kicking shoe attachment as recited in claim 3, wherein said height-adjusting mechanism comprises a scissor jack mechanism or other suitable jack mechanism whereby a vertical space between an upper portion and a lower portion of said two-part solid object may be selectively varied.

6. The kicking shoe attachment as recited in claim 1, wherein said upper sole comprises at least one selected from the group: natural rubber, artificial rubber, and a polymeric elastomer.

7. The kicking shoe attachment as recited in claim 1, wherein said lower sole comprises a wear resistant material.

8. The kicking shoe attachment as recited in claim 7, wherein said lower sole is removably attached to said curvilinear, convex lower surface to facilitate its replacement.

9. The kicking shoe attachment as recited in claim 1, further comprising:

d) a heel receiving cup attached at a lower edge thereof to an upper surface of a heel cup carrier plate, said heel cup receiving plate being attached to at least one of said upper sole and said flat upper surface of said elongated main body.

10. The kicking shoe attachment as recited in claim 9, further comprising:

e) means for slidably receiving and retaining said heel cup carrier plate to said upper surface of said sole, comprising at least one chosen from the group: a heel cup carrier plate receiver affixed to an upper surface of said upper sole, and compatible horizontal grooves in opposing side surfaces of elongated main body, said groves being proximate said upper surface thereof, said heel cup carrier plate being movable forward and reward along a major axis of said an elongated main body; and f) a fastening mechanism disposed in said central core adapted to secure said heel cup carrier plate at a desired position relative to said heel cup carrier plate receiver.

11. The kicking shoe attachment as recited in claim 10, further comprising:

g) a substantially circular opening in said heel cup carrier plate configured for positioning over said opening in said top surface of said central core and said corresponding opening in said upper sole.

12. The kicking shoe attachment as recited in claim 10, further comprising:

g) a substantially circular plug sized and configured for selective insertion into said substantially circular hole.

13. The kicking shoe attachment as recited in claim 12, wherein said central core disposed between said upper sole covering and said lower sole covering and comprises at least one of the group: a solid object of a single material, a solid object of a single material having at least one horizontal circular opening therethrough; a solid object laminated from multiple horizontal layers; a two-part solid object having a resilient material disposed intermediate said two parts, a two-part solid object having at least one mechanical spring disposed intermediate said two parts, and a two-part solid objects having a height-adjusting mechanism disposed intermediate said two parts.

14. The kicking shoe attachment as recited in claim 11, wherein said central core comprises an upper core portion and a lower core portion separated horizontally in a plane substantially parallel to said flat upper surface, said upper core portion and said lower core portion being spaced apart in a vertical dimension by at least one mechanical spring selected from the group: coil springs, leaf springs, and other forms of spring.

15. The kicking shoe attachment as recited in claim 11, wherein said height-adjusting mechanism comprises a scissor jack mechanism or other suitable jack mechanism whereby a vertical space between an upper portion and a lower portion of said two-part solid object may be selectively varied.

16. The kicking shoe attachment as recited in claim 9, wherein said upper sole comprises at least one selected from the group: natural rubber, artificial rubber, and a polymeric elastomer.

17. The kicking shoe attachment as recited in claim 9, wherein said lower sole comprises a wear resistant material.

18. The kicking shoe attachment as recited in claim 17, wherein said lower sole is removably attached to said curvilinear, convex lower surface to facilitate its replacement.

19. The kicking shoe attachment as recited in claim 9, wherein said plug comprises a smooth upper surface having at least one finger recess disposed therein.

20. The kicking shoe attachment as recited in claim 9, further comprising:

g) a tether attached to said elongated body and adapted and configured for securely attaching said kicking shoe attachment to one selected from the group: an environmental structure, and the kick scooter when said kicking shoe attachment is not being worn.

21. The kicking shoe attachment as recited in claim 20, further comprising:

h) a mechanism disposed at said distal end of a tether adapted and configured to attach said distal end to said kicking shoe attachment to prevent dangling of said tether when said kicking shoe attachment is in use during a ride.

22. The kicking shoe attachment as recited in claim 21, further comprising:

i) a mechanism disposed at said distal end of a tether adapted and configured to attach said distal end to said kicking shoe attachment to prevent dangling of said tether when said kicking shoe attachment is in use during a ride.

* * * * *